US006572499B2

(12) United States Patent
Davies

(10) Patent No.: US 6,572,499 B2
(45) Date of Patent: Jun. 3, 2003

(54) VERSATILE PLAY BALL

(76) Inventor: Douglas J. Davies, 6107 Yale Ave., Glen Echo, MD (US) 20812

( * ) Notice: Subject to any disclaimer, the term of this patent is extended or adjusted under 35 U.S.C. 154(b) by 0 days.

(21) Appl. No.: 09/736,245

(22) Filed: Dec. 15, 2000

(65) Prior Publication Data

US 2002/0077201 A1 Jun. 20, 2002

(51) Int. Cl.[7] ..... A63B 43/04
(52) U.S. Cl. ..... 473/604; 473/594
(58) Field of Search ..... 473/593, 594, 473/595, 604, 609, 610, 611; 446/220, 221

(56) References Cited

U.S. PATENT DOCUMENTS 2,540,403 A * 2/1951 Meyers ..... 446/221
2,625,770 A * 1/1953 Steen et al. ..... 473/610
2,635,387 A * 4/1953 Anderson ..... 446/221
2,894,746 A * 7/1959 Chupa ..... 473/610
3,655,197 A * 4/1972 Milbaum ..... 473/594
4,842,563 A * 6/1989 Russell ..... 473/61
4,915,669 A * 4/1990 Russell ..... 473/610
4,966,568 A * 10/1990 Nakamura et al. ..... 446/221
4,991,841 A 2/1991 Paranto
5,070,610 A * 12/1991 Leslie ..... 473/594
5,088,952 A 2/1992 Goldblatt
5,098,329 A * 3/1992 Tseng ..... 473/610
5,102,365 A * 4/1992 Wang ..... 473/610
5,138,721 A * 8/1992 Spector ..... 473/610
5,522,757 A * 6/1996 Ostrowski ..... 446/220
5,891,000 A * 4/1999 Phillips ..... 473/594
6,099,376 A 8/2000 Singhal et al.
6,334,804 B1 * 1/2002 Brown ..... 473/610

* cited by examiner

*Primary Examiner*—Steven Wong
(74) *Attorney, Agent, or Firm*—Dickstein Shapiro Morin & Oshinsky LLP

(57) ABSTRACT

A variable-weight ball that is particularly useful for the development of motor skills in children of all ages is disclosed. A first inflatable bladder filled with a first gas and a second inflatable bladder filled with a second gas are disposed within an outer casing. The relative weight of the ball can be adjusted by using gases of different densities in the first and second bladders and by adjusting the amount of gas in each bladder.

3 Claims, 2 Drawing Sheets

VERSATILE PLAY BALL

FIELD OF THE INVENTION

The present invention relates to the field of educational and training devices and, in particular, to a new and improved training play ball.

BACKGROUND OF THE INVENTION

Educational and training devices such as standard play balls are extremely common, particularly with young children. A standard play ball, for example a soccer ball, has a spherical shape and is made of an inflatable, high strength inner bladder and an outer casing formed of heavy leather, rubber or other flexible material. The inner bladder is provided with a valve which allows the bladder to be inflated with air, the valve automatically closing to retain the air in the bladder. Volley balls, basketballs and footballs are fabricated in a similar manner.

As children today are increasingly interested in refining their motor skills in various sports at a younger-than-ever age, the toy and game industry has continuously recognized the need for more versatile play balls, which would retain their educational characteristics while combining fun and excitement. Because conventional athletic balls are typically heavy and sometimes dangerous for small children, the toy industry has introduced inflated balls that are larger, lighter, softer and potentially less dangerous. As such, balls in various shapes and sizes are now commercially available which are molded of polyurethane foam material and other light-weight compressible plastics. However, while such balls are safer in the hands of small children, they fail to adjust to the motor development of a particular child trying to learn the intricacies of a specific sport at a specific developmental level.

Accordingly, there is a need for an improved novelty play ball for teaching motor skills to children of various ages and at various skill levels. There is also a need for a novelty ball that can be thrown or kicked in a straight path, and that can be readily caught by a young child.

SUMMARY OF THE INVENTION

The present invention provides a novelty play ball that is particularly useful for the development of motor-skill coordination in children of all ages. The present invention provides a variable-weight ball having a first inflatable bladder of elastomeric material disposed within or adjacent to a second inflatable bladder. The first inflatable bladder is filled with a first gas while the second inflatable bladder is filled with a second gas with a density different than that of the first gas. In an exemplary embodiment of the invention, the first gas is air and the second gas is an inert gas, for example helium.

The amount of the second gas that fills the second inflatable bladder is inversely proportional with the weight of the ball, which in turn, is directly related to the skill level of a particular child player. For example, when the second inflatable bladder is partially filled with the second gas, the weight of the ball is reduced so that the player has more time to react while learning to juggle the ball. As the player learns the basics and his/her skills improve, a portion of the second gas is released from the second inner bladder, and more first gas is introduced in the first inner bladder. This way, by varying the amount of the gases contained by their respective bladders, the ball can be tailored to the motor skills of the user. At some point, the ball could be filled entirely with the first gas and have the play characteristics of a conventional ball.

The foregoing and other advantages and features of the invention will be better understood from the following detailed description of the invention, which is provided in connection with the accompanying drawings.

DETAILED DESCRIPTION OF THE DRAWINGS

DETAILED DESCRIPTION OF THE PREFERRED EMBODIMENTS

In the following detailed description, reference is made to various specific embodiments in which the invention may be practiced. These embodiments are described with sufficient detail to enable those skilled in the art to practice the invention, and it is to be understood that other embodiments may be employed, and that structural, logical, and electrical changes may be made, without departing from the spirit and scope of the invention.

The term "ball" used in the following description may include any play ball for children and adults, as well as any training, educational or practice ball for sports such as soccer, football, volleyball, or tennis, among others. Further, the term "ball" used in the following description is to be understood as including not only pneumatic athletic balls with conventional configuration, but also athletic balls with various configurations and external appearances, as long as the ball would exhibit the characteristics of a variable-weight ball of the present invention.

Figure 1:
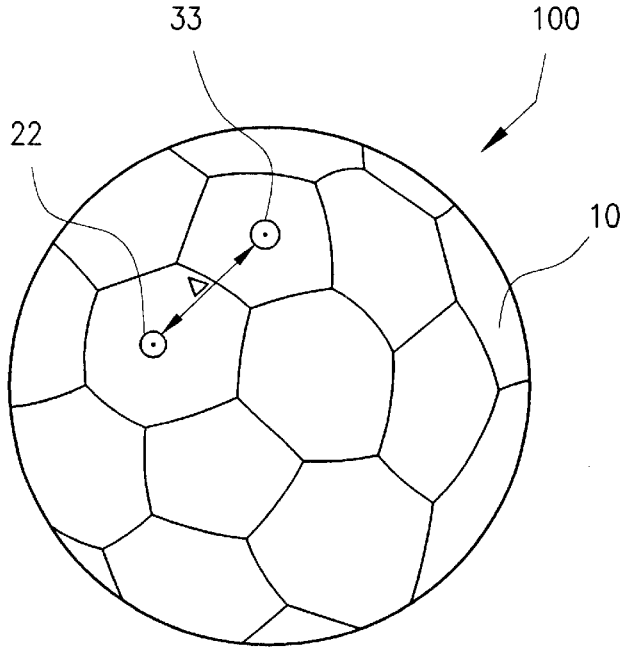
FIG. 1 is a schematic perspective view of a variable-weight ball formed in accordance with a method of the present invention.

Referring now to the figures, where like elements are designated by like reference numerals, FIG. 1 shows a variable-weight play ball 100 formed in accordance with an exemplary embodiment of the present invention. For simplicity, the present invention will be explained with reference to a variable-weight soccer ball 100 having a spherical configuration. However, the invention is not limited to soccer balls, and other play and teaching balls may be used, as desired.

Referring to FIG. 1, the variable-weight play ball 100 comprises an outer casing 10, on which first and second venting valves 22 and 33, respectively, are disposed at a predetermined distance D. As it will be described in more detail below, the first and second venting valves 22 and 33 permit a plurality of gases to enter into, and escape from, respective bladders within the interior of the variable-weight play ball 100. Each of the first and second venting valves 22, 23 is provided with a spring-biased valve element (not shown) which, when manually operated, opens the valve to allow the insertion of gas through the respective valve into the interior of the ball, and which, when released, automatically shuts off the valve.

The outer casing 10 may be formed of conventional materials such as leather, vinyl, polyvinyl, polypropylene, laminated or reinforced plastic film materials of high durability, such as parachute cloth or other closely-woven fabric made of synthetic fibers like nylons. The outer casing 10 may be also formed of other conventional non-stretchable film materials, for example Gore-Tex. In any event, the outer casing 10 is of about 2 to 10 millimeters thick, more preferably of about 5 millimeters thick. The diameter of the outer casing 10 may be equivalent to that of a standard soccer ball or even greater, depending on the level of skill that a particular player possesses.

Figure 2:
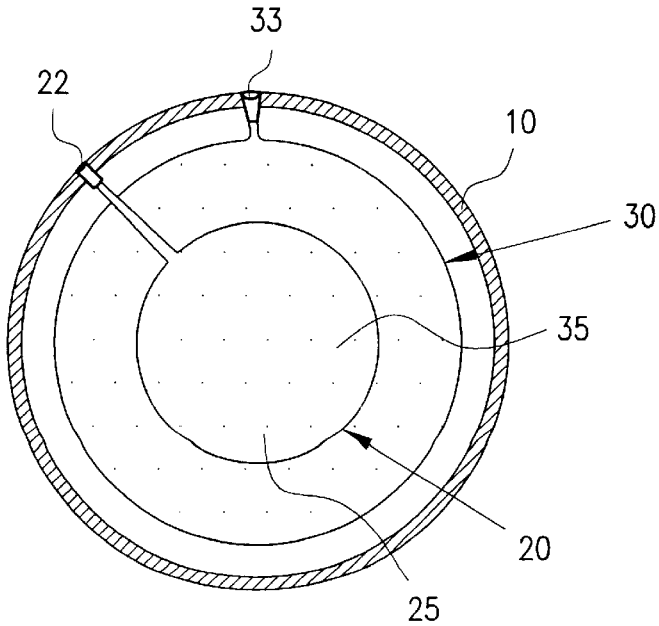
FIG. 2 is a diametrical cross-sectional view of the variable-weight ball of FIG. 1 and in accordance with a first embodiment of the present invention.

Reference is now made to FIG. 2, which illustrates a diametrical cross-sectional view of the variable-weight play ball 100. A first inflatable bladder 20 containing a first gas 25 is disposed within the outer casing 10 and communicates with the exterior of the outer casing 10 through the first venting valve 22. The first gas 25 is introduced into, and released from, the first inflatable bladder 20 through the first venting valve 22.

The first inflatable bladder 20 may be formed of a conventional rubber material which can be inflated and stretched so that its maximum diameter is about less than, or equal to, the diameter of the outer casing 10. Alternatively, when an inert gas is employed as the first gas 25, the first inflatable bladder 20 may be preferably formed of polyethylene terephthalate (also known as Mylar), which has a coating of laminate, for example aluminum (Al), that is impervious to the inert gas contained therein.

Also illustrated in FIG. 2 is a second inflatable bladder 30 interposed between the first inflatable bladder 20 and the outer casing 10. The second inflatable bladder 30 contains a second gas 35 which is introduced into, and released from, the inflatable bladder 30 through the second venting valve 33. Thus, the second inflatable bladder 30 communicates with the exterior of the outer casing 10 through the second venting valve 33. The second inflatable bladder 30 may be formed of a conventional rubber material which can be inflated and stretched so that its maximum diameter is about less than, or equal to, the diameter of the outer casing 10. If, however, an inert gas is employed as the second gas 35, the second inflatable bladder 30 may be preferably formed of polyethylene terephthalate or Mylar, which is impervious to the inert gas contained therein.

The second gas 35 may be any gas which has a density different than the density of the first gas 25. In an exemplary embodiment of the invention, the first gas is air (density of dry air at about 20° C. is of about 1.183 g/l) and the second gas in an inert gas, for example helium or argon (vapor density of helium at about 20° C. is of about 0.18 g/l). The air is introduced into the first inflatable bladder 20 through the first venting valve 22 to a predetermined first volume. Similarly, the inert gas is introduced into the second inflatable bladder 30 through the second venting valve 33 to a predetermined second volume.

The first and second volumes are adjusted depending on the desired weight of the play ball 100. As such, when one player wishes to produce a relatively lighter-weight ball, then a greater amount of inert gas is introduced into the second inflatable bladder 30, so that a smaller amount of air is introduced into the first inflatable bladder 20. If a player with reduced skill level needs to juggle a very light soccer ball, then very little to none amount of air is introduced in the first inflatable bladder 20, so that a maximum amount of inert gas is introduced into the second inflatable bladder 30. Alternatively, if a player needs to have a relatively heavy-weight ball, then more air is introduced into the first inflatable bladder 20, and, accordingly, less inert gas into the second inflatable bladder 30. Thus, the weight of ball 100 is adjustable depending on the skill level of a particular player, in a range where the lower limit corresponds to a maximum amount of inert gas contained by the second inflatable bladder 30 and the upper limit is represented by the absence of the inert gas from the second inflatable bladder 30.

Although the present invention has been illustrated with reference to the formation of a soccer ball, it must be understood that the invention is applicable to any ball for which weight variations concern a player at a particular skill level. For example, the invention is applicable to other types of play balls, such as footballs or volleyballs, among others. Also, although the exemplary embodiment described above refers to the use of air and of an inert gas, it must be understood that the invention is applicable to any gases or combinations of those gases that have different densities. Further, although the invention has been described above with reference to two gases with two different densities, the invention is not limited to the above embodiment and other two materials with different densities, or combinations of those materials, may be used also, as long as their densities varies. Thus, for example, the present invention contemplates the use of an inert gas and a liquid with a light density, or the use of an inert gas and water, among other combinations, for controlling the weight of the soccer ball.

Finally, although the exemplary embodiment described above referred to a plurality of inflatable bladders of spherical configuration, the invention also contemplates the use of inflatable bladders with other geometrical configurations, as long as they are capable of storing a gas, liquid and/or a combination of gas/liquid. Further, although the invention was described with reference to a plurality of inflatable bladders of which the one containing the lighter-density gas completely surrounds the one containing the heavier-density gas, it must be understood that the inflatable bladder containing the heavier-density gas could also completely surround the inflatable bladder containing the lighter-density gas.

Figure 3:
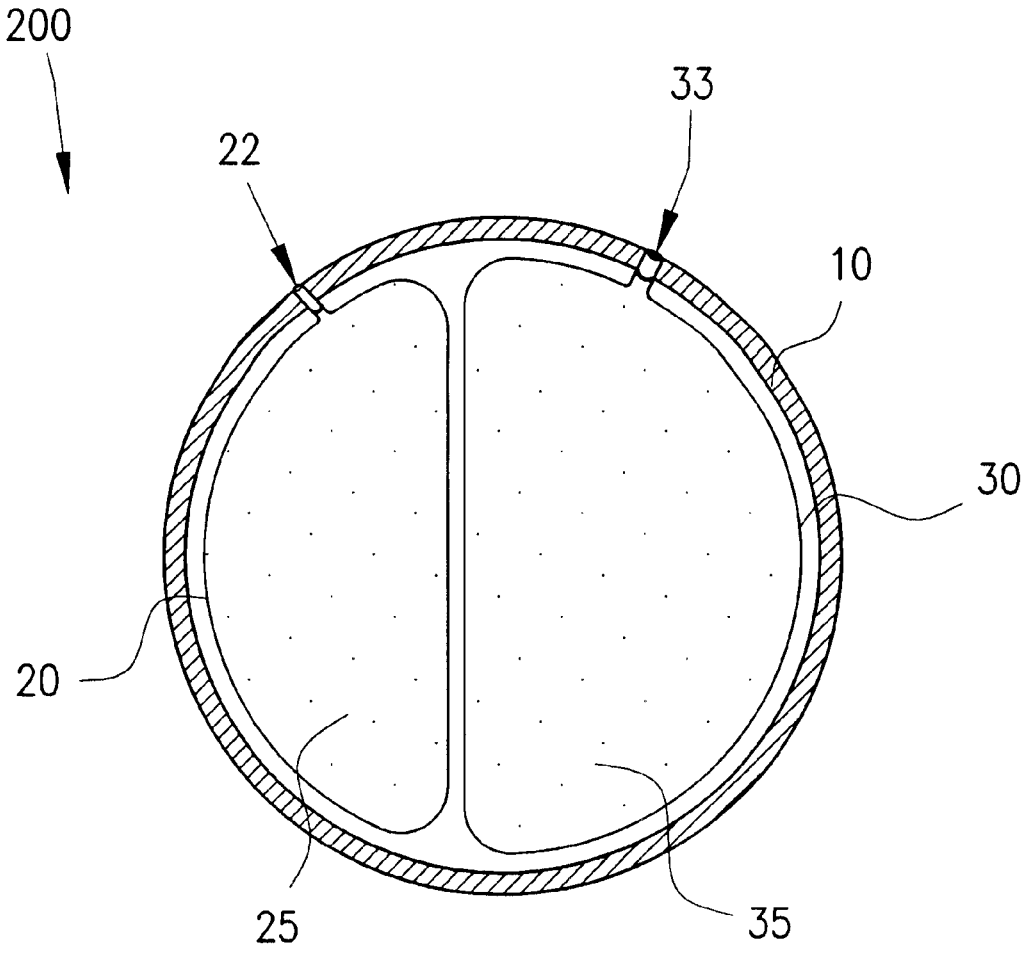
FIG. 3 is a diametrical cross-sectional view of the variable-weight ball of FIG. 1 and in accordance with a second embodiment of the present invention.

Although the exemplary embodiment has been described above with reference to two concentric spherical compartments, the compartments need not be concentric and/or spherical but can have any geometry and be disposed in various ways inside of the outer casing 10. For example, FIG. 3 illustrates another embodiment of a variable-weight play ball 200, in which the two inflatable bladders 20, 30 are located adjacent to one another within the outer casing 10, and without a spherical shape.

A variable-weight ball, such as the variable-weight play balls 100, 200 of the present invention, has many practical uses. Such a variable-weight ball can be successfully used to improve a young soccer player's ball handling skills. Initially, a young unskilled player could use a light-weighted ball, such as the variable-weight ball 100 filled mostly with an inert gas, to learn how to juggle the ball with feet, knees or head. Being filled mostly with an inert gas, the ball falls slower than a conventional soccer ball, giving therefore the young soccer player more time to react while learning the intricacies of the game. As the player's juggling skills improve, portions of the inert gas are incrementally released so that more of the gas with a heavier density could be introduced. This way, the ball becomes heavier and more difficult to juggle.

The above description illustrates preferred embodiments that achieve the features and advantages of the present invention. It is not intended that the present invention be limited to the illustrated embodiments. Modifications and substitutions to specific process conditions and structures can be made without departing from the spirit and scope of the present invention. Accordingly, the invention is not to be considered as being limited by the foregoing description and drawings, but is only limited by the scope of the appended claims.

What is claimed as new and desired to be protected by Letters Patent of the United States is:

1. A variable-weight ball comprising:

an outer casing having a predetermined diameter;

a first inflatable bladder located within said outer casing, said first inflatable bladder containing a gas; and a second inflatable bladder located within said outer casing, said second inflatable bladder containing an inert gas.

2. A variable-weight ball comprising:

an outer casing having a predetermined diameter;

a first inflatable bladder located within said outer casing, said first inflatable bladder containing air; and a second inflatable bladder located within said outer casing, said second inflatable bladder containing helium.

3. A variable-weight ball comprising:

an outer casing having a predetermined diameter;

a first inflatable bladder located within said outer casing, said first inflatable bladder containing a first material of a first density; and a second inflatable bladder located within said outer casing, said second inflatable bladder containing a second material of a second density; wherein said first and said second inflatable bladders are adjacent to each other.

* * * * *